US005220535A

United States Patent [19]

Brigham et al.

[11] Patent Number: 5,220,535

[45] Date of Patent: Jun. 15, 1993

[54] SONAR BAFFLES

[75] Inventors: Gerald A. Brigham, Portsmouth; Peter F. Flanagan, Cranston, both of R.I.

[73] Assignee: Raytheon Company, Lexington, Mass.

[21] Appl. No.: 731,408

[22] Filed: Jun. 18, 1991

[51] Int. Cl.[5] ..... H04K 3/00

[52] U.S. Cl. ..... 367/1

[58] Field of Search ..... 367/1

[56] References Cited

U.S. PATENT DOCUMENTS 3,412,513 11/1968 Gosele ..... 181/290

*Primary Examiner*—Daniel T. Pihulic

*Attorney, Agent, or Firm*—Donald F. Mofford; Richard M. Sharkansky

[57] ABSTRACT

A split cylinder compliant tube baffle for absorbing and/or canceling noise signals generated within a submarine or surface ship is described. The split cylinder tube baffle includes an air-filled tube having a longitudinal gap extending the length of the tube. The baffle further comprises a rubber jacket for enclosing the gap and end covers for sealing end portions of the tube. A split tube baffle assembly is generally constructed of tube baffles adjacently aligned to form a panel. The panels can then be stacked for increased attenuation of acoustic signals. The split cylinder baffle offers significant size reduction and improved performance over conventional compliant tube baffle designs.

18 Claims, 5 Drawing Sheets

SONAR BAFFLES

BACKGROUND OF THE INVENTION

This invention relates generally to sonar baffles and more particularly to compliant baffles.

As is known in the art, a baffle is a device that acts as a partition for preventing interference between sound waves in separate, adjacent enclosures. In general, sonar baffles are energy canceling or energy absorbing devices in which undesired acoustic noise is reduced by such mechanisms as shear and/or torsion absorption or cancellation of the signals by the generation of equal signals that are out of phase with respect to signals received by the baffle. In sonar systems, baffles are typically used to isolate highly sensitive acoustic receivers from undesired acoustic signals, generally referred to as noise. In such systems, it is generally desired to increase the overall response of a sonar system to a desired signal by decreasing the response of the system to the undesired noise.

In many applications, passive sonar receiving systems, such as hydrophone arrays, are located on moving vessels for detecting acoustic signals propagating in the ocean. Noise generated on or by the moving vessel, such as machinery noise, hydrodynamic noise, and the noise produced by the activities of the vessel's crew is typically called "self noise" and can mask a desired signal received by the hydrophone array. Moving vessels such as submarines and ships have hulls generally constructed of large metal plates mounted to bulkheads. The metal plates are easily excited into flexural vibration by the on-board machinery and hydrodynamic noise and act as an acoustic radiator to the ocean medium. In one application, a sonar baffle assembly is placed between a highly sensitive hydrophone array and the hull of a ship or submarine. The baffle minimizes the acoustic energy propagating from the hull structure by absorbing the acoustic energy within the sonar baffle and/or by reflecting the acoustic energy back to the hull. Some of the sources of radiated noise produce a line-component spectrum in which the noise is dominated by tonal components at a fundamental frequency and related harmonics of the vibration producing process. Other sources of radiated noise produce a generally continuous spectrum related to the excitation of structural members, such as the hull, into resonance. This type of noise, sometimes called high wavenumber noise, does not generate propagating acoustic waves and is referred to as evanescent in nature. Accordingly, while this slow-wave, non-propagating noise is unlikely to be detected by an unfriendly listener some distance away, it is likely to overload the output of an adjacent hydrophone array used to detect acoustic signals propagating in the ocean.

There are a wide variety of sonar baffles having different sizes, shapes, and material compositions generally dependent on the particular application and the frequency of operation.

One sonar baffle configuration used in underwater environments is the compliant plate baffle. The compliant plate baffle typically has a pair of flexible metallic or composite material plates coupled together with ball joint hinges at each end of the plates. The plates have lengths chosen to resonate at frequencies typical of the undesired acoustic signals and are generally separated by a nylon insert for dampening the resonant acoustic signals. The hinged flexible plate assemblies are generally embedded in a rigid polymer plastic material such as polyurethane for protection against the corrosive effects of salt water. Acoustic signals incident on the compliant baffle assembly pass easily through the polyurethane and resonate the hinged plates. Although compliant plate baffles provide some absorption to incident acoustic signals, ordinarily, compliant baffles are designed to cancel the incoming acoustic signals. Acoustic signals incident on the baffle assembly cause the plates to contract and then expand back to their original shape, releasing a pressure wave at the frequency of the incident signal but with a differential phase shift. This response will generally provide partial cancellation of the incident acoustic signals thereby providing isolation to the receiver. Due to the inherent size and strength of the materials used in their construction, the compliant plate baffle provides high insertion loss to undesired acoustic signals and can withstand high hydrostatic pressure characteristics typical of deep ocean depths. However, compliant plate baffle manufacturing costs are relatively high, compared with other baffle designs, due to the large number of component parts required in each assembly.

Another baffle configuration used in underwater systems is the compliant oval-shaped tube baffle. Compliant oval-shaped tube baffle assemblies include a plurality of elliptically shaped or oval flexible tubes generally fabricated of metal or composite materials. Compliant oval-shaped tube baffles are pressure or energy canceling devices and operate in the same way as compliant plate baffles. The compliant oval-shaped tubes are generally encapsulated and are generally uniformly oriented such that the minor diameters of the elliptical tubes essentially define the thickness of a layer of the baffle. Encapsulation of the baffle assembly is generally undesirable since this process may allow the generation of other modes and provide absorption of the incoming signal which reduces the peak insertion loss of the device. However, encapsulation is usually required for protecting the baffle against the corrosive effects of saltwater and industrial solvents and for ease of handling the assembly.

One problem with the compliant oval-shaped tube baffle having uniformly oriented oval-shaped tubes is that within the band of operation, certain frequencies excite the oval-shaped tubes in what are known as antisymmetric modes. Acoustic signals at these frequencies pass through the baffle with little attenuation. The theory of acoustic frequency "shorts" due to resonance and coupling of antisymmetric tube modes has been published in an article entitled "Scattering by multiple gratings of compliant tubes" by Radlinski and Janus, J. Acoust. Soc. Am. 80(6), December 1986.

Another problem with the compliant oval-shaped tube baffle relates to its displacement profile during excitation. In operation, the excited oval shaped compliant tube has portions which compress the surrounding medium while other portions of the tube concurrently rarefy the medium. In such situations, the displacement pattern is said to have both positive and negative displacements. In the case of the oval compliant tube, during the first half cycle of excitation, the vertices of the oval tube have a negative displacement, while the broad walls of the tube are providing positive displacement. This effect generally reduces the complaint oval tube's efficiency in reflecting back the incident wave. This effect also provides additional mechanical stress in the tube. The measure of positive displacement in relation to concurrent negative displacement is called volume flow. Baffles having low volume flow store less acoustic energy, reradiate less energy and accordingly, have reduced insertion loss characteristics.

Further, because the compliant oval-shaped tube baffles are fabricated from continuous hollow oval tubes and are uncompensated, circumferential stresses due to hydrostatic pressure can be significant. These stresses are related to the bending stiffness characteristic of the tube and its geometry.

Both compliant tube and compliant plate baffles have the additional problem of having reduced effectiveness in attenuating small size flexural wavelength noise. This ineffectiveness is related to the large size of the compliant devices relative to the evanescent wavelength. The short wavelengths of the flexural noise appear almost transparent to the much larger compliant tubes and plates.

Still another baffle commonly used when lightweight, smaller size, easy installation and maintenance, and low cost are needed, is the voided elastomer or so-called "air/rubber" baffle. The air/rubber baffle generally has a construction that includes sheets of energy absorbent material, such as rubber, having an arrangement of densely packed air-hole pockets disposed within each sheet. The diameters of the air-hole pockets are predetermined to limit the transmission of the undesired acoustic waves incident upon the baffle. Although the air/rubber baffle does not provide insertion loss of the magnitude typical of the costlier and heavier compliant plate baffle, the simplicity of its design makes it popular for use for many applications.

One problem with the air/rubber baffle is its relative ineffectiveness at ocean depths where high hydrostatic pressure conditions exist. The problem of hydrostatic pressure loading is not unique to sonar baffles, and commonly changes the operating characteristics of many components (e.g. transducers) used in sonar systems. In the case of an air/rubber baffle, these high pressure conditions can compress the energy absorbent sheets to the extent that they no longer absorb acoustic energy incident upon them, or at the very least, physically change the geometry of the air-hole pockets such that undesired acoustic signals propagate through the baffle without being attenuated.

In addition, the air/rubber baffle is generally unsuitable for use in environments where underwater explosions can occur. In these situations, very high hydrodynamic pressure conditions provide pressure levels beyond the strength capabilities of the elastomer material. Cracks generally form in the material which allow the air-hole cavities to fill with water, resulting in an inoperable sonar baffle.

In the application described previously, a sonar baffle assembly is placed between a hydrophone array and a hull structure. In this type of application, compliant plate baffle assemblies are typically disposed directly beneath the hydrophone array to take advantage of their high insertion loss characteristics, while voided elastomer baffles or compliant oval-shaped tube baffles are disposed adjacent to and around the perimeter of the compliant plate baffle assemblies.

SUMMARY OF THE INVENTION

In accordance with the present invention, a baffle includes a hollow cylindrical tube having a length, end portions, and a longitudinal slot extending the length of the tube. The baffle further includes means for sealing the gap of the tube and means for enclosing the end portions of the tube. With such an arrangement, the longitudinal slot provides an air-filled baffle with a resonant frequency lower than an unslotted tube of the same geometry and concomitantly provides a baffle of reduced size which is fabricated with fewer parts than conventional compliant baffles.

In accordance with a further aspect of the invention, a baffle assembly includes a plurality of adjacently aligned hollow tubes, each one of the plurality of tubes having a length, end portions, and a longitudinal slot extending the length of the tubes. The baffle assembly further includes means for sealing the gap of each one of the plurality of tubes and means for enclosing the end portions of each one of the plurality of tubes. With such an arrangement, a low frequency baffle assembly is provided with decreased thickness and increased insertion loss to small wavelength ship hull flexural waves. Further, the baffle assembly is capable of being operational at ocean depths where high hydrostatic pressure conditions exist.

In accordance with a further aspect of the invention, a baffle assembly includes a plurality of panels. Each panel includes a plurality of hollow cylindrical tubes, each one of the tubes having a length, end portion, and a longitudinal slot extending the length of the tube. The plurality of tubes are preferably aligned adjacently and the slots of the plurality of tubes are randomly aligned relative to each other. Each panel further includes a pair of endcovers disposed over the pair of end portions of each of the tubes and a rubber seal disposed over the slot of each one of the hollow tubes. The rubber seal further has a looped portion extending into the slot of the tube for providing a water tight seal to inner portions of the tube and concurrently allows the contraction and expansion of the tube when subjected to incident waves. With such an arrangement, by using cylindrical shaped tubes having slots, a sonar baffle assembly is provided with decreased thickness and increased insertion loss and bandwidth characteristics. Further, the random orientation of the slots within each of the plurality of cylindrical tubes eliminates or at least substantially eliminates the effects of antisymmetric modes without increasing the thickness of the baffle assembly or significantly altering other characteristics of the baffle.

BRIEF DESCRIPTION OF THE DRAWINGS

The foregoing features of this invention, as well as the invention itself, may be more fully understood by the following detailed description of the drawings, in which.

DESCRIPTION OF THE PREFERRED EMBODIMENTS

Figure 1:
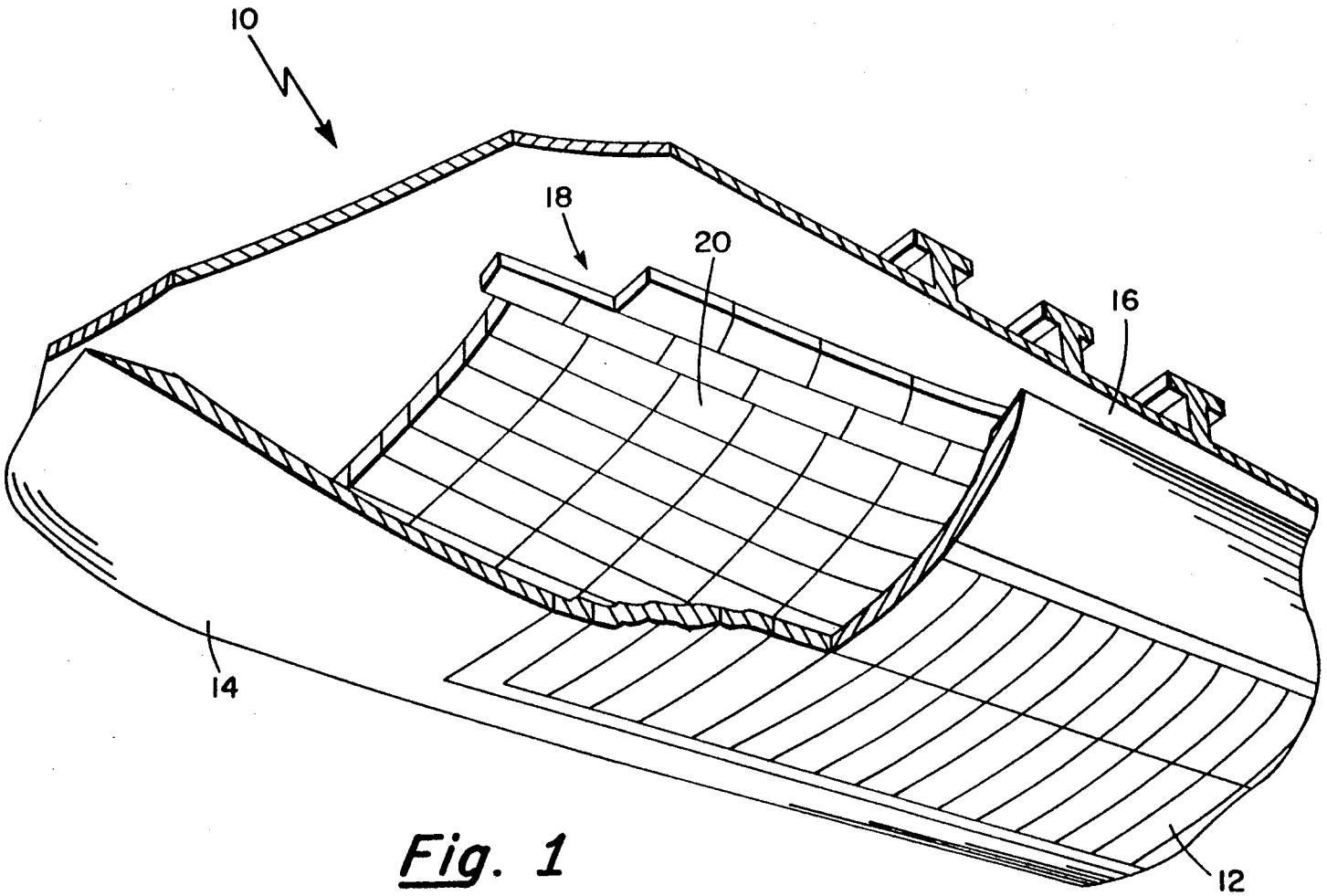
FIG. 1 is an isometric view, partially broken away, of a sonar wide aperture hydrophone array system having a split cylinder compliant tube baffle assembly disposed between a hydrophone array and a hull of a ship.

Referring now to FIG. 1, a portion of a submarine 10 is shown having a conformal hydrophone array 12 disposed within a fairing 14 and over a portion of a hull of the submarine 16. Disposed between the hydrophone array 12 and the hull of the submarine 16 is a sonar baffle assembly 18 having a plurality of cylindrical compliant tube baffle panels 20.

In operation, the array of highly sensitive hydrophone elements 12 are used to receive acoustic signals propagating in the ocean. The sonar baffle assembly 18 provides an acoustic barrier between the hydrophone array 12 and the hull of the submarine 16 for minimizing undesired acoustic signals generated on or by the moving submarine from being received by the array 12. Rails (not shown) are generally welded to the hull 16 for mounting the cylindrical compliant tube baffle panels 20 in applications where the baffle assembly is offset from the hull and the array.

Figure 2:
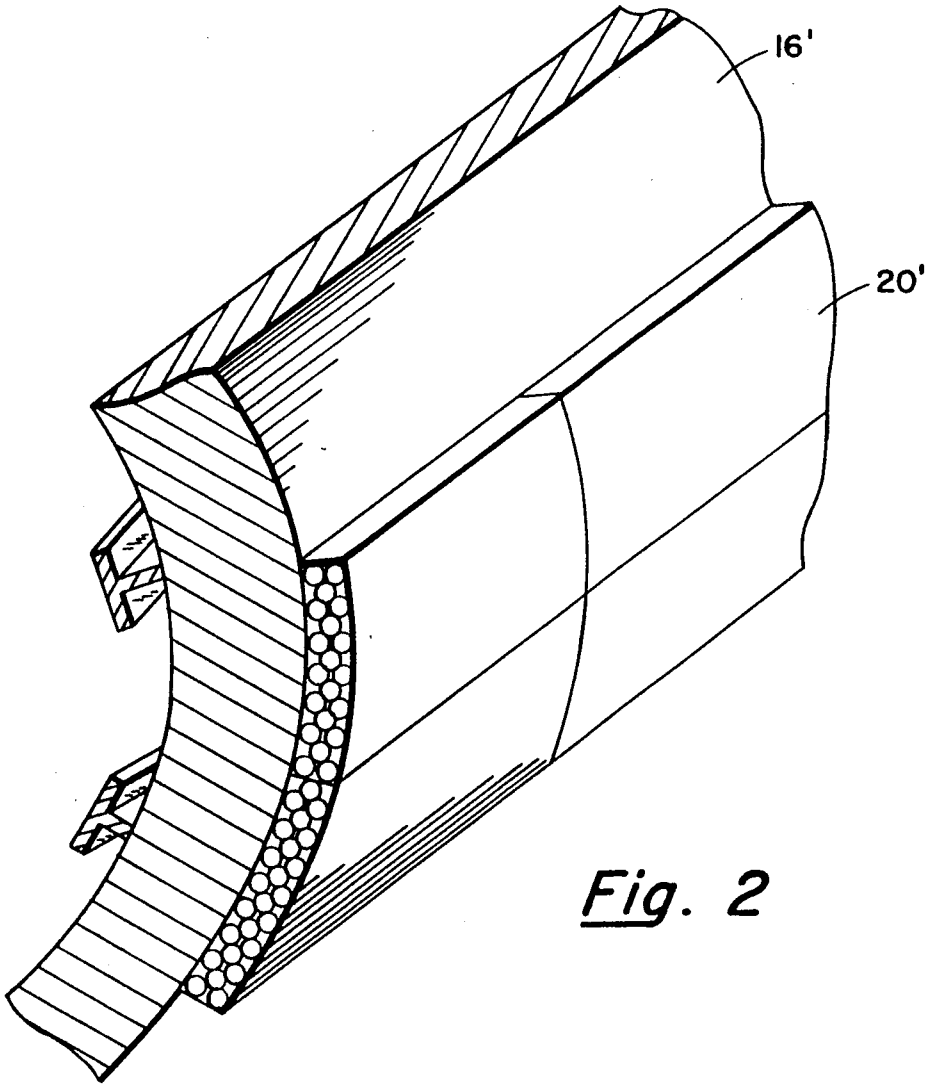
FIG. 2 is an isometric view, partially broken away, of a cylinder compliant tube baffle assembly disposed on the hull of a ship.

Referring now to FIG. 2, a plurality of cylindrical compliant tube baffles panels 20' are shown disposed directly on a hull of a submarine or ship 16'. Mounted in this way, the baffle assembly provides a barrier to acoustic signals generated from within the submarine. Vibrations produced by on-board machinery and the propeller travel easily through the hull and are reradiated into the ocean medium, where they may be detected by unfriendly listening devices.

Figure 3:
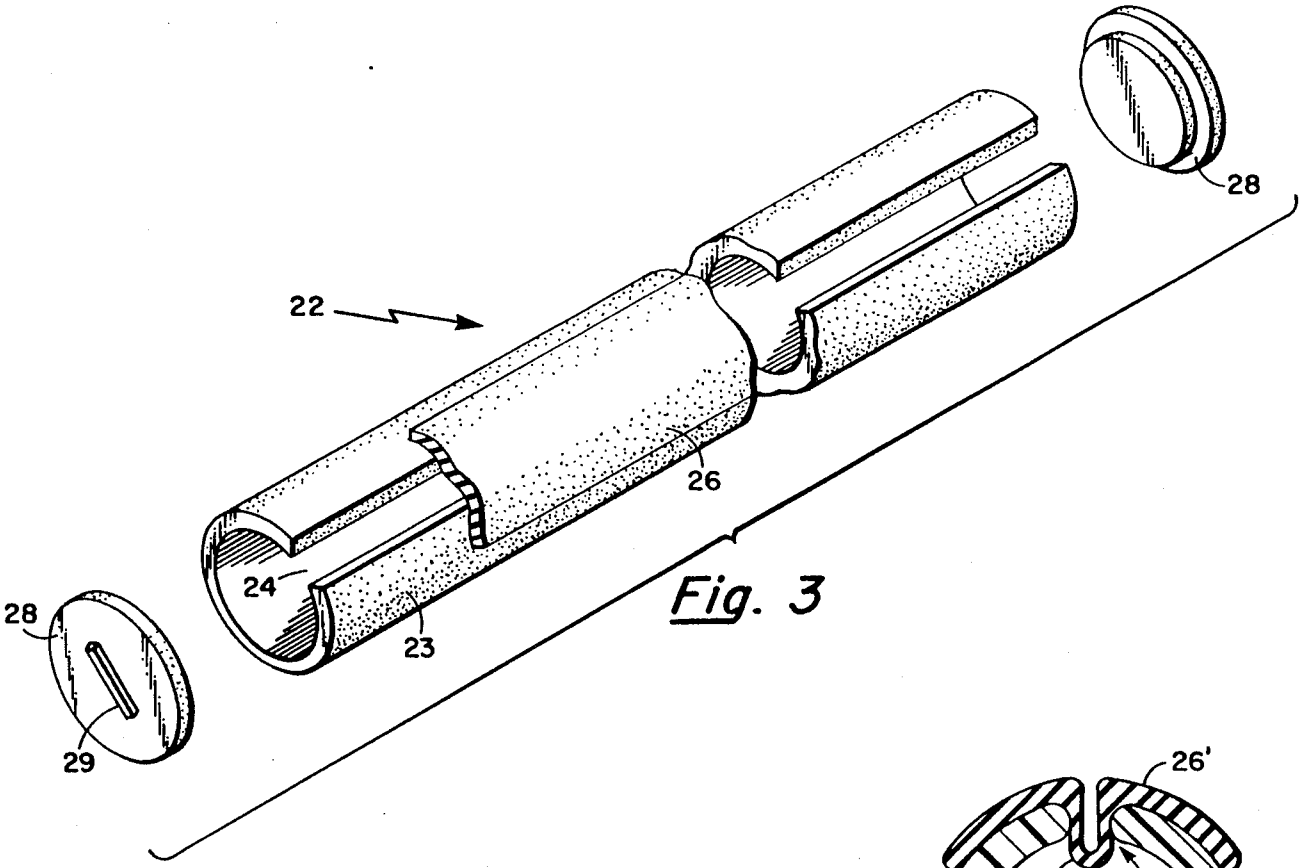
FIG. 3 is an isometric view, partially broken away, of a cylinder compliant tube and gap seal.
Figure 4:
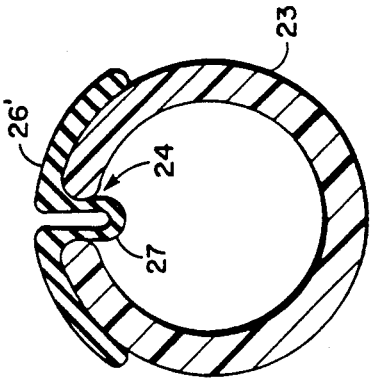
FIG. 4 is a cross-sectional view of a portion of the cylinder compliant tube taken along lines 4—4 of FIG. 3.

Referring now to FIGS. 3–4, a cylindrical compliant tube baffle 22 is shown to include a tube 23 having generally thin walls and fabricated from a resilient material. Suitable materials include glass composites, polymer plastics, or certain metals, such as aluminum. The selection of the material is generally related to the ocean depth at which the baffle is used. As is known by those of ordinary skill in the art, hydrostatic pressure increases with ocean depth and can compress the cylindrical tubes to the extent that their ability to absorb acoustic energy incident upon them is reduced. Stiffer materials such as metals or glass composites may be required for applications where such high hydrostatic pressure conditions exist. These cylindrical compliant tube baffles 22 can be used at significantly greater depths than voided elastomer baffles and have the same depth capability as other larger compliant tube baffles.

The tube 23 has a slot 24 disposed along the full length of the tube and a membrane seal 26 disposed over the slot for providing a watertight seal at the slot. Further, end portions of each tube are enclosed with an endcover 28 or plug for preventing the passage of water to the inner portion of the tube 23. The seal 26 and endcovers 28 provide an air-filled tube and are generally made from a rubber impregnated fabric or other material which is highly impermeable to water. The membrane seal 26 and endcaps 28 are affixed to the tube 23 using a water impermeable adhesive such as an epoxy, here Magnabond 55-3, a product of Magnolia Plastics, Chamblee, Ga. In applications, where the baffles are to be used at great ocean depths, the cylindrical compliant tubes may be pressurized or "precharged" with air or other suitable gases such that high hydrostatic pressure, characteristic of such depths, are neutralized. The endcovers may include a raised rib handle 29 for engaging a portion of a panel enclosure such as a rail. An arrangement using such endcovers is discussed later in conjunction with FIG. 5.

In operation, acoustic signals incident upon the cylindrical tube baffle 22 cause the "C" shaped hollow tube 23 to vibrate. The hollow tube has a resonant frequency approximated by the following relationship:

$$f = \frac{h}{50a^2}\sqrt{\frac{E}{\rho}}$$

where h = wall thickness (cm)

a = radius to the neutral axis of the tube (cm)

E = elasticity modulus of the tube material (gm/cm sec$^2$)

$\rho$ = density of the tube material (gm/cm$^3$)

The hollow cylindrical tube 23 inherently has a point of zero displacement, called a node, which is at a location opposite the slot 24. The compliant cylindrical tube 23 operates similarly to a tuning fork, having two equal cantilever arms. That is the displacement of the portion of the tube 23 adjacent the node is relatively small in comparison to the displacement of the portion of the tube adjacent the slot 24.

The cylindrical tube 23 with the slot 24 is significantly smaller in cross-section than either a compliant oval-shaped tube or compliant plate device used at a comparable frequency and consequently considerably more effective in providing pressure cancellation of small size flexural wavelength noise emanating from a ship or submarine hull.

The slot 24 provides a noncontinuous cylinder which in addition to lowering the resonant frequency of the tube, greatly reduces the internal membrane stresses within the tube. The reduction of these membrane stresses can significantly increase the compliance of the tube.

Referring now to FIG. 4, the cylindrical compliant tube 23 is shown having a roll seal 26' disposed over the slot 24 of the tube 23. The roll seal 26' has a loop 27 of U-shaped cross-section which extends radially downward into the slot 24. The roll seal 26' provides a watertight seal to the interior of the tube, while concomitantly allowing the circumferential expansion and contraction of the tube with respect to the tube endcovers (FIG. 3). A reinforced water-impermeable material such as reinforced rubber, composite plastic or a metal which is sufficiently thin so that it has the flexibility to configure itself into a loop 27 of approximately circular cross-section and having high tensile strength sufficient to resist stretching are suitable. The roll seal 26' is secured to the tube 23 using a water impermeable adhesive, such as the aforementioned Magnabond 55-3 epoxy. Alternate embodiments for providing a roll seal for the tube 23 may be adapted from those provided for cylindrical transducers as discussed in co-pending application Serial No. 286689 filed on Dec. 20, 1988 filed by K. D. Rolt and P. F. Flanagan, entitled "Sound Reinforcing Seal for Slotted Acoustic Transducers" and assigned to the assignee of the present invention.

Figure 5:
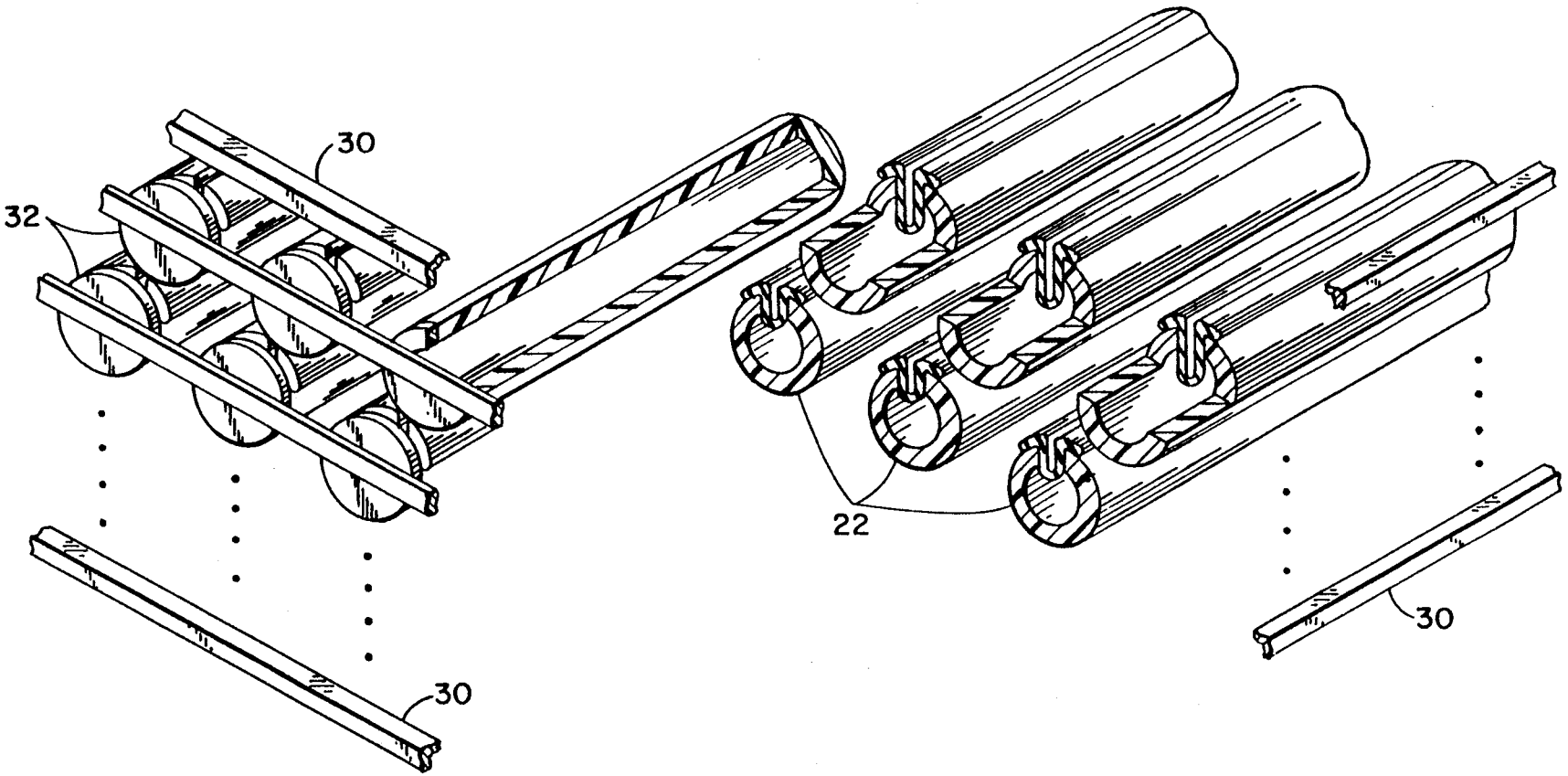
FIG. 5 is an isometric view, partially broken away, of an assembled split cylinder compliant tube baffle array.

Referring now to FIG. 5, a cylindrical compliant tube baffle panel 20 is shown to include a plurality of cylindrical compliant tubes 22. The plurality of tubes are disposed adjacent to one another for providing a panel of cylindrical compliant tubes. It is generally desired that the tubes are not encapsulated, but are allowed to be in contact with the transmission medium. In such an arrangement, the baffle provides better attenuation to incident acoustic signals. The unencapsulated baffle is generally encased in an envelope covering. The tubes are shown here encased within an open cage frame 30. The frame includes a plurality of rails 32 extending across and secured to opposite endportions of the frame. The rails 32 generally have slots (not shown) to allow the raised rib handle (FIG. 3) of the compliant tube endcovers to slide into the slot of each rail 32. It is generally desirable to have neighboring tubes with a relatively close spacing for providing greater insertion loss over a given area. Spacers (not shown) may be required between adjacent tubes for providing the proper separation. Alternatively, the outer diameter of the endcovers may be chosen to be larger than the tube diameter, such that the adjacent tube endcovers are in contact with each other, without inhibiting the movement of the tubes.

In applications where increased insertion loss levels are required, a stacked arrangement of layers of compliant cylindrical tube baffle panels can be provided by fitting a plurality of parallel rails 32 on the aforementioned frame 30.

It is believed that the effects of antisymmetric modes commonly excited in symmetric arrangements of both conventional compliant oval-shaped tubes and slotted cylindrical or oval compliant tube baffles in accordance with the present invention may be substantially eliminated by the random orientation of the tubes. However, due to their geometry, the random orientation of conventional compliant oval-shaped tubes provides a baffle assembly which is substantially thicker. This drawback is also present in the slotted oval-shaped tubes of the present invention. However, because the cylindrical tube baffles are circular in cross-section, the orientation of the individual slots in an cylindrical compliant tube baffle can be randomly directed or oriented without a change in thickness of the baffle assembly.

In other applications it may be required that the plurality of tubes be encapsulated in a lossy elastomer or other suitable material to provide for general ease in handling and storing the baffle panels and for protecting the compliant cylindrical tubes against the corrosive effects of seawater and harbor pollutants.

Figure 6:
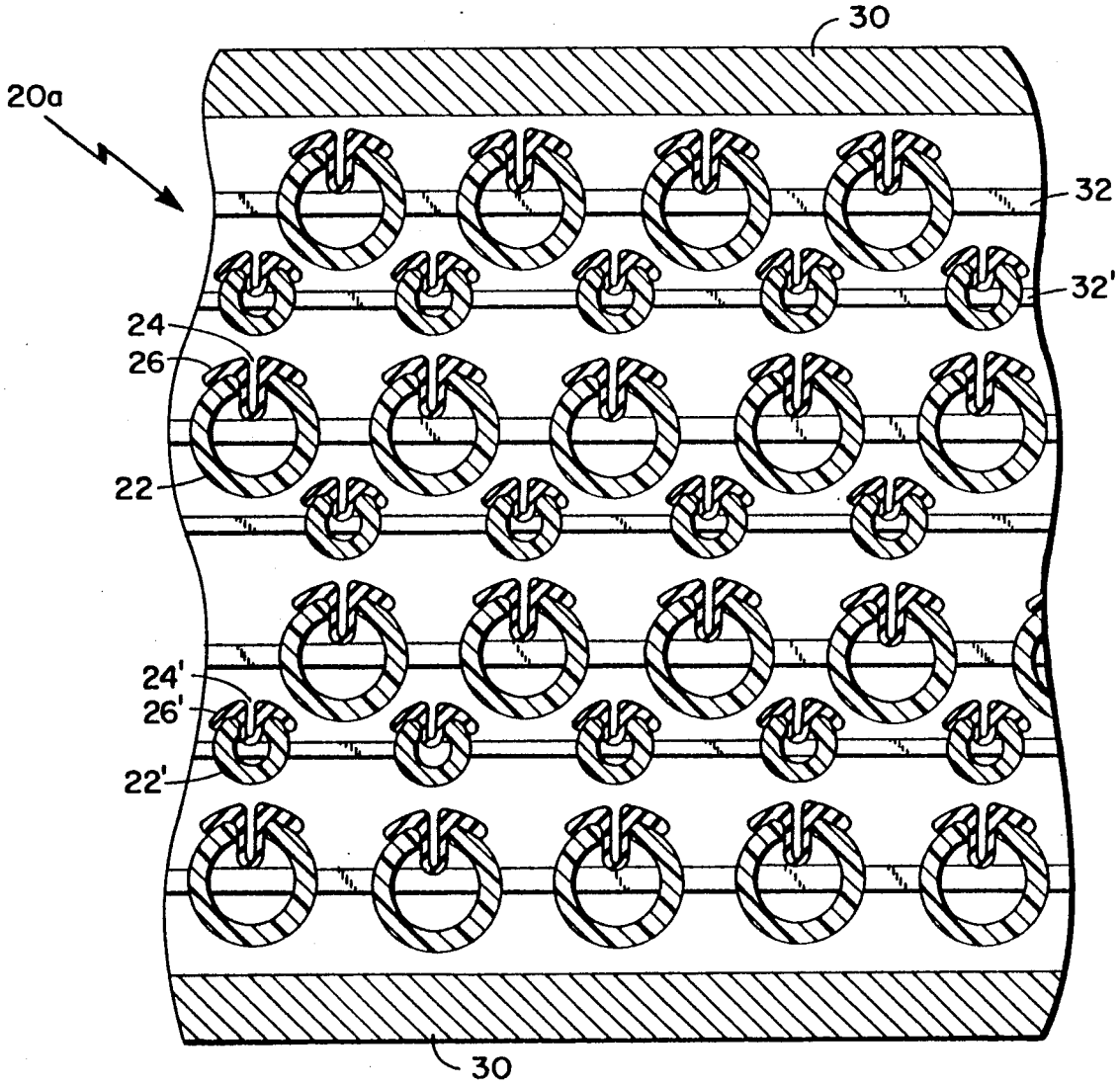
FIG. 6 is a cross-sectional view of a portion of an alternate embodiment of a cylindrical compliant tube baffle array.

Referring now to FIG. 6, a cross-sectional view of a cylindrical compliant tube baffle panel 20*a* is shown to include a plurality of cylindrical compliant tubes 22 having slots 24 and identical but smaller cylindrical compliant tubes 22' having slots 24'. It is generally desired to have a baffle assembly having closely packed cylindrical compliant tubes for providing the maximum amount of insertion loss for a given area. In such applications, complaint cylindrical tubes 22' having smaller cross-sectional circumferences can be nested among cylindrical tubes 22 having larger circumferences or as shown here, alternating layers of tubes having different diameters. The compliant cylindrical tubes 22, 22' are shown here, disposed within an open cage frame 30 and supported within the frame by a corresponding plurality of rails 32, 32', respectively.

Having described a preferred embodiment of the invention, it will be apparent to one of skill in the art that other embodiments incorporating its concept may be used. It is believed, therefore, that this invention should not be restricted to the disclosed embodiment but rather should be limited only by the spirit and scope of the appended claims.

What is claimed is:

1. A baffle comprising:

a hollow tube having a length, end portions, and a longitudinal slot extending the length of the tube;

means for sealing the slot of said tube; and means for enclosing the end portions of the tube.

2. The baffle of claim 1 wherein said means for enclosing the end portions of said tube includes a pair of end covers disposed over each of said end portions.

3. The baffle of claim 1 wherein said means for sealing the gap of the tube includes a flexible membrane disposed over said gap of said tube for forming a water tight barrier to an interior portion of said tube.

4. The baffle of claim 3 wherein said flexible membrane has a looped portion extending into the gap of said tube.

5. The baffle of claim 1 wherein said hollow tube is cylindrical.

6. A baffle assembly comprising:

a plurality of hollow cylindrical tubes, each one of said plurality of tubes having a length, end portions, and a longitudinal slot extending the length of the tube wherein the plurality of tubes are aligned adjacently to one another; and means for sealing the gap of each one of said plurality of tubes; and means for enclosing the end portions of each one of said plurality of tubes.

7. The baffle assembly of claim 6 wherein said means for enclosing the end portions of each one of said plurality of tubes includes a pair of end covers disposed over each of said end portions.

8. The baffle assembly of claim 6 wherein said means for sealing the slot of each one of said plurality of tubes includes a flexible membrane disposed over the slot of each one of said hollow tubes for providing a water tight barrier to an interior portion of each one of said tubes.

9. The baffle assembly of claim 8 wherein said flexible material has a looped portion extending into the slot of each one of said tubes.

10. The baffle assembly of claim 6 wherein the slots of said plurality of tubes are randomly aligned relative to each other.

11. The baffle assembly of claim 6 wherein said plurality of tubes are encapsulated in an elastomer material.

12. A baffle assembly comprising:

a panel comprising:

a plurality of hollow cylindrical tubes, each one of said plurality of tubes having a length, a pair of end portions, and a longitudinal slot extending the length of the tube wherein the plurality of tubes are aligned adjacently to one another;

a pair of endcovers disposed over the pair of end portions of each of said plurality of tubes;

a rubber seal disposed over the slot of each one of said hollow tubes, wherein the seal has a looped portion extending into the gap of each one of said tubes.

13. The baffle assembly of claim 12 wherein the slots of said plurality of tubes are randomly aligned relative to each other.

14. The baffle assembly comprising:

a plurality of panels each panel comprising:

a plurality of hollow cylindrical tubes, each one of said plurality of tubes having a length, end portions, and a longitudinal slot extending the length of the tube wherein the plurality of tubes are aligned adjacently to one another and the slots of the plurality of tubes are randomly aligned relative to each other;

a pair of endcovers disposed over the pair of end portions of each of said plurality of tubes;

a rubber seal disposed over the slot of each one of said hollow tubes, wherein the seal has a looped portion extending into the slot of each one of said tubes.

15. The baffle assembly of claim 14 wherein said plurality of cylindrical tubes comprises a first plurality of cylindrical tubes having a first circumference and a second plurality of cylindrical tubes having a second circumference wherein said first circumference is larger than said second circumference.

16. The baffle as recited in claim 1 wherein said hollow tube is air-filled.

17. A baffle surrounded by a fluid medium, said baffle comprising:

a hollow tube having a longitudinal slot, said tube being disposed in contact with said surrounding fluid medium.

18. The baffle as recited in claim 17 further comprising means for sealing the slot to isolate the hollow tube from the surrounding fluid medium.

* * * * *